United States Patent [19]

Sherman, III

[11] Patent Number: 4,944,505

[45] Date of Patent: Jul. 31, 1990

[54] SHEET LENGTH DETECTOR WITH SKEW COMPENSATION

[75] Inventor: William Sherman, III, Medford, N.J.

[73] Assignee: Brandt, Inc., Bensalem, Pa.

[21] Appl. No.: 303,248

[22] Filed: Jan. 30, 1989

[51] Int. Cl.[5] ..... B65H 43/00

[52] U.S. Cl. ..... 271/265; 271/227; 356/383; 250/560; 209/586

[58] Field of Search ..... 271/110, 111, 227, 228, 271/265; 356/383, 385, 386, 400; 209/586, 534; 250/560

[56] References Cited

U.S. PATENT DOCUMENTS

| | | | |
|---|---|---|---|
| 2,933,185 | 4/1960 | Coleman et al. | 209/586 |
| 3,240,487 | 3/1966 | Templeton | 271/228 |
| 3,386,576 | 6/1968 | Niemeyer et al. | 209/586 |
| 3,621,266 | 11/1971 | Akuta et al. | 250/560 |
| 4,248,267 | 3/1981 | Feldkämper | 356/386 |
| 4,506,969 | 3/1985 | Baker | 356/385 |
| 4,623,975 | 11/1986 | Kagami | 356/387 |
| 4,664,369 | 5/1987 | Graef et al. | 271/263 |
| 4,671,502 | 6/1987 | Sherman et al. | 271/265 |
| 4,741,526 | 5/1988 | Reed | 271/227 |
| 4,761,002 | 8/1988 | Reed et al. | 271/111 |
| 4,825,248 | 4/1989 | Honjo et al. | 271/265 |

FOREIGN PATENT DOCUMENTS

| | | | |
|---|---|---|---|
| 48546 | 3/1982 | Japan | 271/227 |
| 142503 | 9/1982 | Japan | 250/560 |
| 23054 | 1/1986 | Japan | 271/227 |
| 31641 | 2/1987 | Japan | 271/227 |

OTHER PUBLICATIONS

Church et al., "Dynamic Sheet Length Sensing", *IBM Technical Disclosure,* vol. 18, No. 2, p. 330, Jul. 1975.

*Primary Examiner*—Joseph J. Rolla
*Assistant Examiner*—Steven M. Reiss
*Attorney, Agent, or Firm*—Shenier & O'Connor

[57] ABSTRACT

A sheet length detector with skew compensation for use in apparatus for batching and counting currency, food stamps or the like. Sheets are advanced past a pair of sheet sensors which are disposed at transversely spaced locations on the feed path on either side of the nip formed by a pair of opposing feed members. A timing interval is begun upon the actuation of both sheet sensors and ended upon the deactuation of both sensors following their initial actuation. The duration of the timing interval provides a measure of sheet length. This measure is then corrected for skew, which is determined from the time lapse, if any, between the deactuation of one sensor and the deactuation of both sensors. The corrected measure may be compared with an absolute reference or with the results of a previous length measurement.

14 Claims, 5 Drawing Sheets

FIG. 3
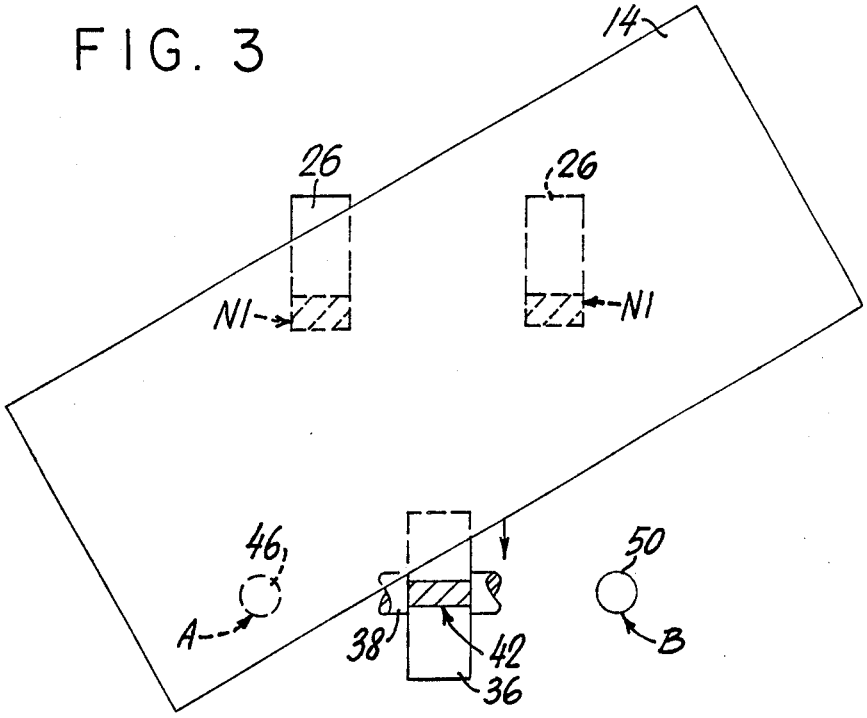
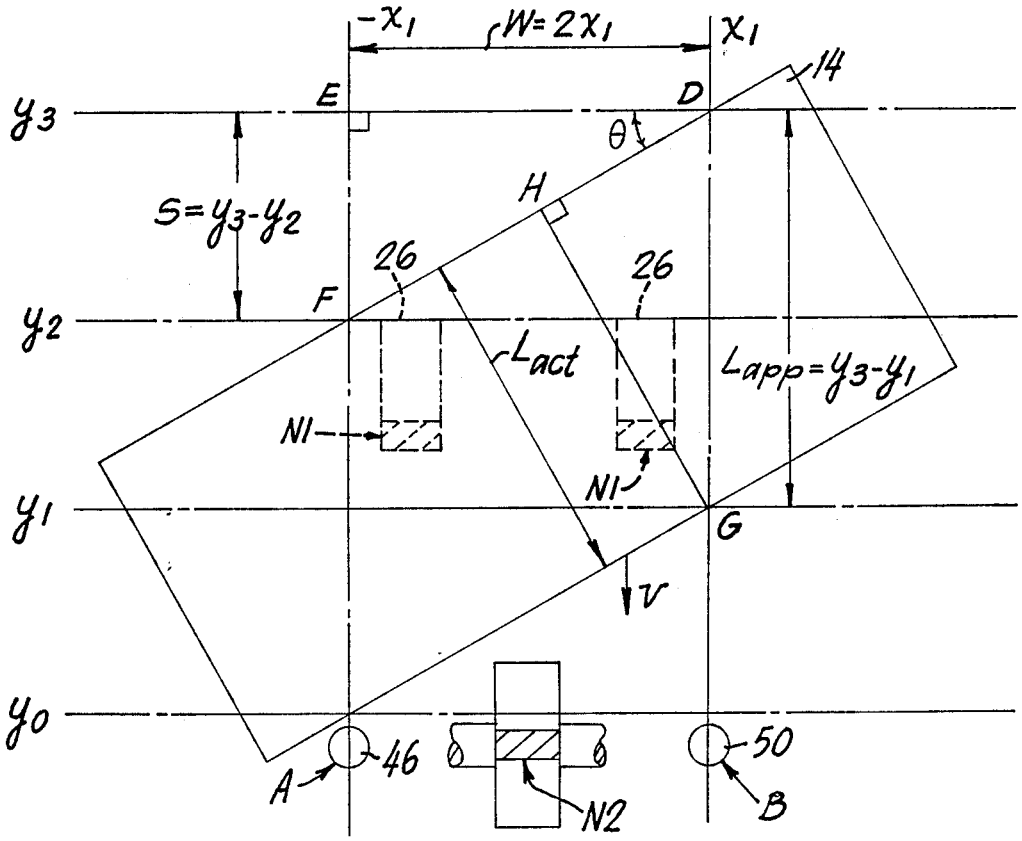
FIG. 4

SHEET LENGTH DETECTOR WITH SKEW COMPENSATION

FIELD OF THE INVENTION

This invention relates to a method and apparatus for measuring the length of sheets such as currency, checks, food stamps or the like.

BACKGROUND OF THE INVENTION

Document handlers and counters for such documents as currency, checks, food stamps or the like are well known in the art, being disclosed in such references as U.S. Pat. Nos. 4,474,365 and 4,741,526. In such systems, it is important to obtain an accurate measurement of the length of the sheets being processed to detect such abnormalities as over-lapped notes, "chain notes", half notes in the direction of feed or the like. Typically, in such systems, the sheets are advanced widthwise past a pair of transversely spaced sensors, and the sheet length (i.e., dimension in the direction of feed) is determined from the period of time required to traverse the sensors. To improve the accuracy of the length measurement, the duration is often determined by counting pulses that are generated by a shaft encoder synchronously with the rotation of the feed member.

Such systems work well enough if the sheets are traveling with their leading edges perpendicular to the direction of movement. Owing to inevitable variations in driving force, this almost never happens, and the sheets are skewed to some extent. Any attempt to measure the length of such a skewed sheet simply by measuring the duration that either sensor is actuated or the duration that both sensors are actuated will result in inaccuracies.

U.S. Pat. No. 4,741,526, referred to above, discloses a system which determines the degree of skew from the delay between the time the leading edge of the document is detected by the first of the transversely spaced sensors and the time the leading edge is detected by the second of the sensors. The system then calculates a document length by multiplying the apparent length between the leading and trailing edges of the document by the cosine of the skew angle. Systems of this type are subject to error, however, when a document has not completely entered a feed nip and is slipping relative to the drive train. In such an instance, a long sensor actuation will erroneously be interpreted as a long document.

SUMMARY OF THE INVENTION

One object of my invention is to provide a sheet length detector which compensates for skew.

Another object of my invention is to provide a sheet length detector which operates even where there is initial sheet slippage.

Other and further objects will be apparent from the following description.

In general, my invention contemplates a sheet length detector in which sheets are successively advanced past a pair of sheet sensors which are disposed at transversely spaced locations on the feed path on either side of the nip formed by a pair of opposing feed members. A timing interval is begun upon the actuation of both sheet sensors and is ended upon the subsequent deactuation of both sheet sensors following their initial actuation. The duration of the timing interval, which is preferably measured using pulses generated synchronously with the movement of the feed member, provides a measure of the sheet length. This measure is then corrected for skew, which is determined from the time lapse, if any, between the deactuation of one sensor and the deactuation of both sensors. The corrected measure may be compared with a fixed reference or, if desired, with a previously obtained length measurement or composite of such measurements.

This method of length detection is especially effective in minimizing inaccuracies due to slippage, since the friction feed members of the systems described above are generally most effective in the region of the sensors. By starting the timing interval only when both sensors have been actuated, I ensure that the sheet has become fully enmeshed in the drive train.

BRIEF DESCRIPTION OF THE DRAWINGS

In the accompanying drawings to which reference is made in the instant specification and which are to be read in conjunction therewith and in which like reference characters are used to indicate like parts in the various views:

FIG. 3 is a schematic view of the feed path as viewed from the front of the sheet feeder shown in FIG. 1.

FIG. 4 is another schematic view of the feed path, illustrating the spatial relationships between the leading and trailing edges of a skewed sheet and the path sensors.

DESCRIPTION OF THE PREFERRED EMBODIMENT

Figure 1:
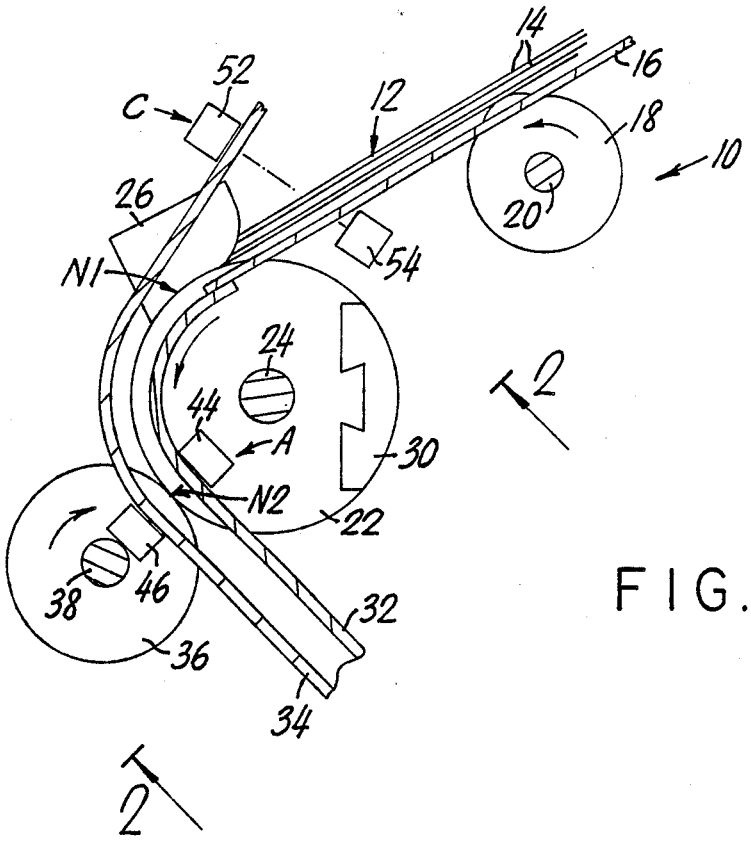
FIG. 1 is a fragmentary section of a sheet feeder incorporating my sheet length detector.
Figure 2:
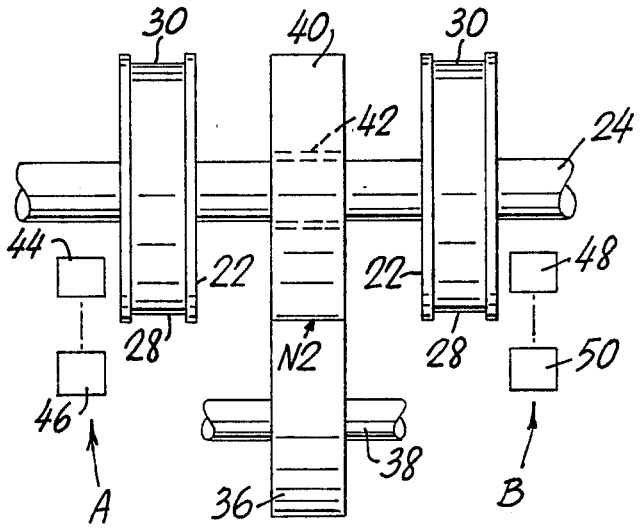
FIG. 2 is a fragmentary view of the sheet feeder of FIG. 1 along line 2–2 thereof, with parts omitted.

Referring now to FIG. 1, a sheet feeder, indicated generally by the reference numeral 10, incorporating my sheet length detector includes a tray 16 for supporting a stack 12 of sheet documents 14, which may be checks, currency, food stamps or the like. Tray 16 is inclined upwardly to the right as viewed in FIG. 1 to bias the stack 12 of sheets 14 into a first pair of nips N1 (hereinafter referred to as simply "the first nip") formed by a pair of feed rollers 22 supported on a shaft 24 at spaced locations therealong for rotation therewith, and stationary stripper members 26. Referring now also to FIG. 2, each of feed rollers 22 has a reduced central portion 28 to form an indentation into which the corresponding stripper shoe 26 extends. Feed rollers 22 comprise a low-friction material such as plastic over the major portion of their peripheries, but carry high-friction inserts 30 of serrated rubber or the like over an angular extent of approximately 90°. Referring again to FIG. 1, a pair of picker rollers 18 supported by a shaft 20 for rotation therewith have lobed portions which extend upwardly through slots (not shown) in tray 16 to engage the bottom sheet 14 frictionally and urge it into the first nip N1.

Feed rollers 22 then draw the bottom sheet 14 through the nip N1 upon rotation of the high-friction inserts 30 past the stripper members 26. Inserts 30 and stripper members 26 are formed of such materials that the coefficient of friction between a sheet 14 and the stripper members 26 is greater than the coefficient of friction between two contacting sheets 14, but less than the coefficient of friction between a sheet 14 and inserts 30. Stripper members 26 are so spaced from the reduced portions 28 of feed rollers 22 as to allow the passage of only a single sheet 14 therebetween. Owing to this spacing and relation of frictional coefficients, feed rollers 22 draw a bottom sheet 14 through the first nip N1 upon each full revolution, while stripper members 26 retard the passage of any additional sheets through the nip N1. Feed rollers 22 continue to advance the sheet 14 around the peripheries of the rollers between a front guide 32 and a rear guide 34 (not shown in FIG. 2) into a second nip N2. Nip N2 is formed by a drive roller 36, supported on a shaft 38 on the lower side of the feed path, and an idler roller 40 supported on feed roller shaft 24 between feed rollers 30 by a bearing 42 for rotation relative to shaft 24. Drive roller 36 continues to advance the sheet of paper 14 between guides 32 and 34 toward downstream feed elements (not shown) of the feeder 10.

Sheets 14 are arranged with their long sides transverse to the feed path so that they are fed widthwise. Thus, the "length" referred to herein is actually the shorter dimension of the sheets 14. Preferably, to ensure continuity of feed, the length of the sheets 14 along the feed path is greater than the separation between the first nip N1 and the second nip N2.

A first path sensor A comprises a light source 44, such as a light-emitting diode (LED), and a photodetector 46 such as a photodiode. Light source 44 is disposed above the feed path in register with the second nip N2, but to the left of feed rollers 22 as viewed from the front of the feeder 10 in FIG. 2. Photodetector 46 is disposed at the corresponding location beneath the feed path. A second path sensor B comprises a light source 48 similar to light source 44 and a light detector 50 similar to detector 46. Light source 48 is disposed above the feed path in register with nip N2, but to the right of feed rollers 22 as shown in FIG. 2. Photodetector 50 is mounted at the corresponding location beneath the feed path. In the absence of an adjacent sheet 14, light sources 44 and 48 direct respective beams of light on photodetectors 46 and 50 through slots (not shown) in guides 32 and 34. Movement of a sheet 14 past sensors A and B interrupts these beams to cause sensors A and B to provide signals indicating the presence of the sheet. Although sensors A and B are shown as being in register with nip N2, they may alternatively be placed downstream of the nip if desired.

In addition to path sensors A and B sheet feeder 10 also has a tray sensor C, comprising a light source 52 mounted behind rear guide 34 and a photodetector 54 disposed beneath tray 16. In the absence of any sheets 14 on the tray 16, light source 52 directs a beam of light through slots (not shown) in guide 34 and tray !6 onto detector 54 to cause the detector to generate an output indicating that the tray 16 is empty.

Figure 5:
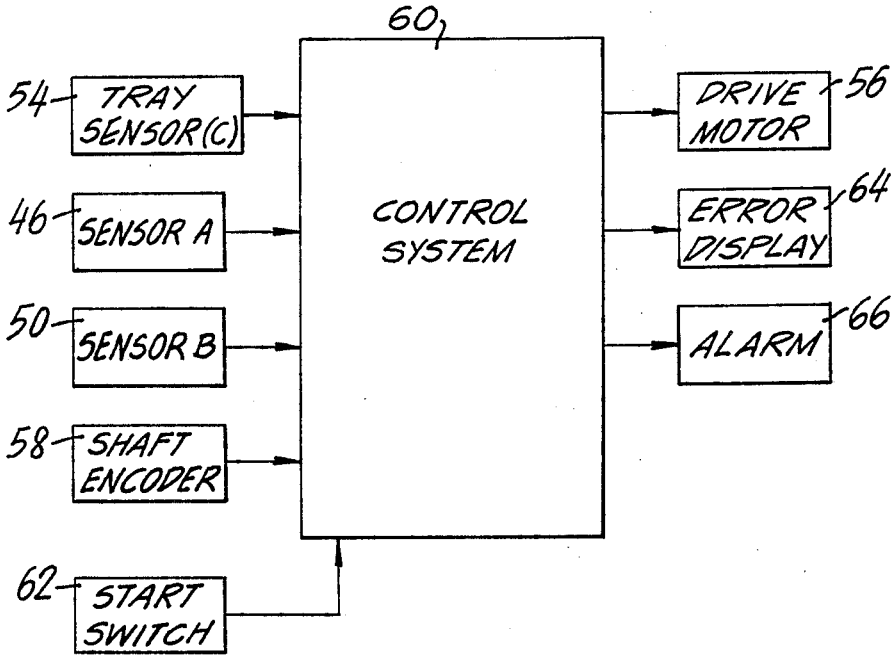
FIG. 5 is a schematic diagram of the electrical and electromechanical components of the sheet feeder shown in FIG. 1.

Referring now also to FIG. 5, sensors A, B and C have their outputs coupled to a control system 60, which may be of any suitable type known to the art, such as one including a microprocessor and associated memory elements (not separately shown). Control system 60 also receives an input from a start switch 62 as well as a shaft encoder 58 carried by shaft 38. Shaft encoder provides control system 60 with a train of pulses that are synchronous with the rotation of the shaft 38. Since each pulse from shaft encoder 58 thus represents a predetermined angular displacement of shaft 38, the shaft encoder permits the control system 60 to accurately track the position of the sheet 14, despite any momentary fluctuations in the drive speed. Control system 60 also drives various output devices, including a motor 56 which drives shafts 20, 24 and 38. Control system 60 also drives an error display 64 of any suitable type known to the art, which is used to display a suitable error message in response to detection of a sheet misfeed. Control system 60 also drives an audible alarm 66, such as a beeper.

Sensors A and B are used to measure the length of sheets 14 passing through the second nip N2 to determine whether the lengths are within an acceptable range. Such a length measurement, however, can be rendered almost meaningless if, because of slippage, a skewed sheet is temporarily halted along the feed path, but nevertheless covers one of the sensors A and B. Such halting is especially likely to occur in a sheet feeder of the type shown, in which the feed rollers 22 are designed to provide only intermittent feed through the first nip N1.

Thus, referring now to FIG. 3, a sheet 14 may be temporarily halted before it reaches the second nip N owing to frictional contact between the sheet 14 and the stripper members 26 forming the first nip N1 with feed rollers 22. If the sheet 14 is also skewed, as shown in FIG. 3, it may cover one of the path sensors (in this instance, sensor A) even though the sheet has not entered the second nip N2. Thus, if one attempts to measure the length of sheet 14 by counting the pulses from encoder 38 during the time that sensor A is covered, one will obtain an inordinately high measurement owing to the halting of the sheet. Such an erroneous length measurement is likely to result in the erroneous declaration of a misfeed, even if the sheet 14 is of the proper size and thereafter enters the second nip N2.

My invention overcomes this problem by beginning the timing interval used for length measurement only after both sensors A and B are covered. Since the second nip N2 is directly in line with or upstream from sensors A and B, coverage of both sensors necessarily implies that the sheet 14 is within the nip N2, even if the sheet is skewed as in FIG. 3. Since the measurement interval thus begins only when the sheet is firmly entrained in the nip N2, any measurement inaccuracies due to slippage are eliminated.

FIG. 4 illustrates in more detail the spatial relationships between a sheet 14 and path sensors A and B. In the figure is shown a skewed sheet 14 moving along the feed path at a velocity v toward sensors A and B. Sensors A and B are located respectively at positions $-x_1$ and $x_1$ across the feed path, where the transverse sensor separation $W=2x_1$. At the instant shown in FIG. 4, the leading edge of sheet 14 intersects the vertical lines $x=-x_1$ and $x=x_1$ at locations having respective y-coordinates $y_0$ and $y_1$. Similarly, the trailing sheet edge intersects the same vertical lines at locations having respective y-coordinates $y_2$ and $y_3$.

The apparent sheet length $L_{app}=y_3-y_1$ of skewed sheet 14 is greater than the actual sheet length $L_{act}$. As is apparent from an examination of the right triangle DEF, these quantities are related by the equation $$L_{act}=L_{app}\cos\Theta$$

where $\Theta$ is the skew angle. The observed skew S may be defined as the difference between the y-coordinate of the trailing sheet edge along the track of sensor B ($x=x_1$) and the y-coordinate of the same edge along the track of sensor A ($x=-x_1$)--i.e., $S=(y_3y_2)$. An examination of the right triangle DGH in FIG. 4 will establish that the quantity S is related to the sensor separation W by the equation $$S=W \tan \Theta.$$

These last two equations can be combined to yield the following equation for determining the actual length $L_{act}$ from the quantities W and $y_1$ through $y_3$:

$$L_{act}=K(y_3-y_2)\,(y_3-y_1)$$

where $$K(y_3-y_2)=[1+(y_3 31\ y_2)2/W^2]-\tfrac{1}{2}$$

Figure 6:
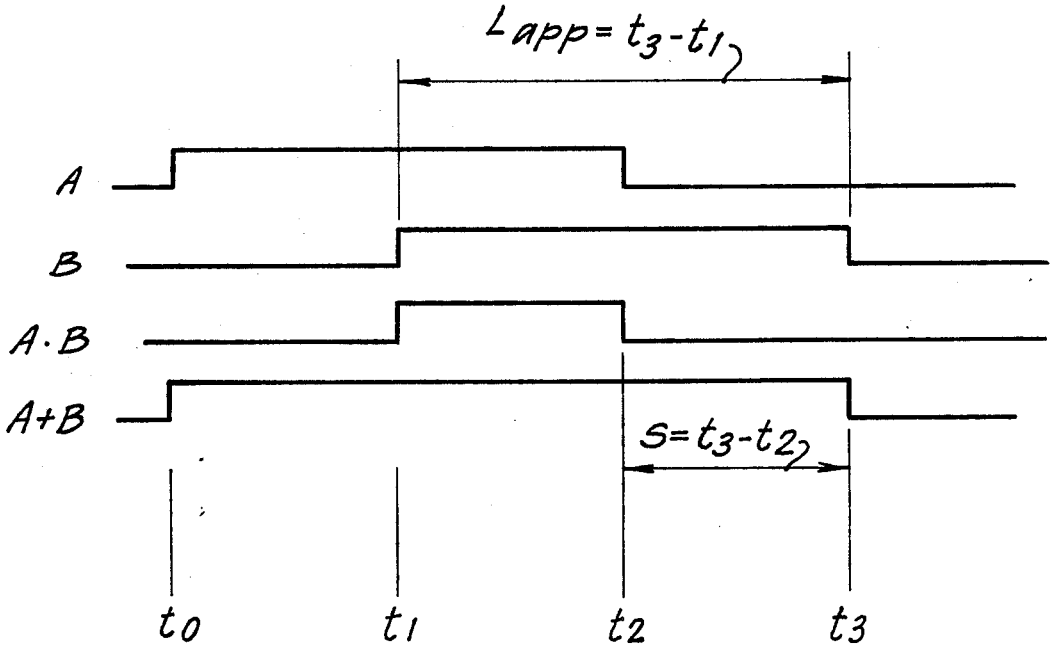
FIG. 6 is a timing diagram illustrating the sensor outputs for the skewed sheet of FIG. 4.

FIG. 6 shows the respective digitized outputs A and B of sensors A and B, where it is assumed that the sensor outputs have a 0 logic level when unactuated (i.e., when a sensor is not covered) and 1 logic level when actuated (i.e., when a sensor is covered). Although the quantity along the t-axis is referred to as "time" herein, it will be understood that the quantity t, being derived from the output of a shaft encoder, actually represents the angular displacement of the encoder and the rotating member to which it is coupled. Since the angular velocity of the encoder wheel may vary, the quantity t is not necessarily equivalent to the actual elapsed time as measured, for example, by a counter coupled to a fixed-frequency pulse generator.

At time $t_O$ the leading edge portion of the sheet 14 passes sensor A, actuating the sensor and producing an A signal at logic 1. Thereafter, at $t_1$, the leading edge portion of the sheet passes sensor B, actuating that sensor to produce a B signal at logic 1. Some time thereafter, at $t_2$, the sheet clears sensor A, deactuating the sensor to cause the sensor signal to return to logic 0. Finally, at $t_3$, the sheet clears sensor B as well, and the signal B likewise returns to 0. The time values $t_0$—$t_3$ are related to the y-coordinates $y_O$-$y_3$ of FIG. 4 by the equation $t_n-t_0=(y_n-y_0)/v$, where n=1, 2 or 3.

Also shown in FIG. 6 are the logical AND value AB and the logical OR value A +B. Obviously, neither of these values accurately reflects the true length of the sheet 14, or even the apparent length as seen by either of the sensors A and B. On the other hand, the quantity $t_3-t_1$, representing the difference between the time that both sensors are actuated and the time that both sensors are deactuated, indicates the apparent sheet length as seen by the second sensor encountered by sheet 14, in this case sensor B. The actual length estimate, of course, would be multiplied by the scale factor v, as well as by the cosine of the skew angle Θ--i.e., it would be cos $\Theta v(t_3-t_1)$. To simplify the following discussion, it will be assumed that the scale factor v is unitary, so that the quantities $t_n$ can be equated with the quantities $y_n$.

To summarize the foregoing, the apparent length of the sheet 14 is measured by noting the lapse between the time both sensors are covered and the time that both sensors are uncovered. At the same time, the skew S is determined by noting the lapse between the time that at least one sensor is uncovered and the time that both sensors are uncovered. The actual length $L_{act}$ is then computed from the apparent length $L_{app}$ using the above equation.

Figure 7:
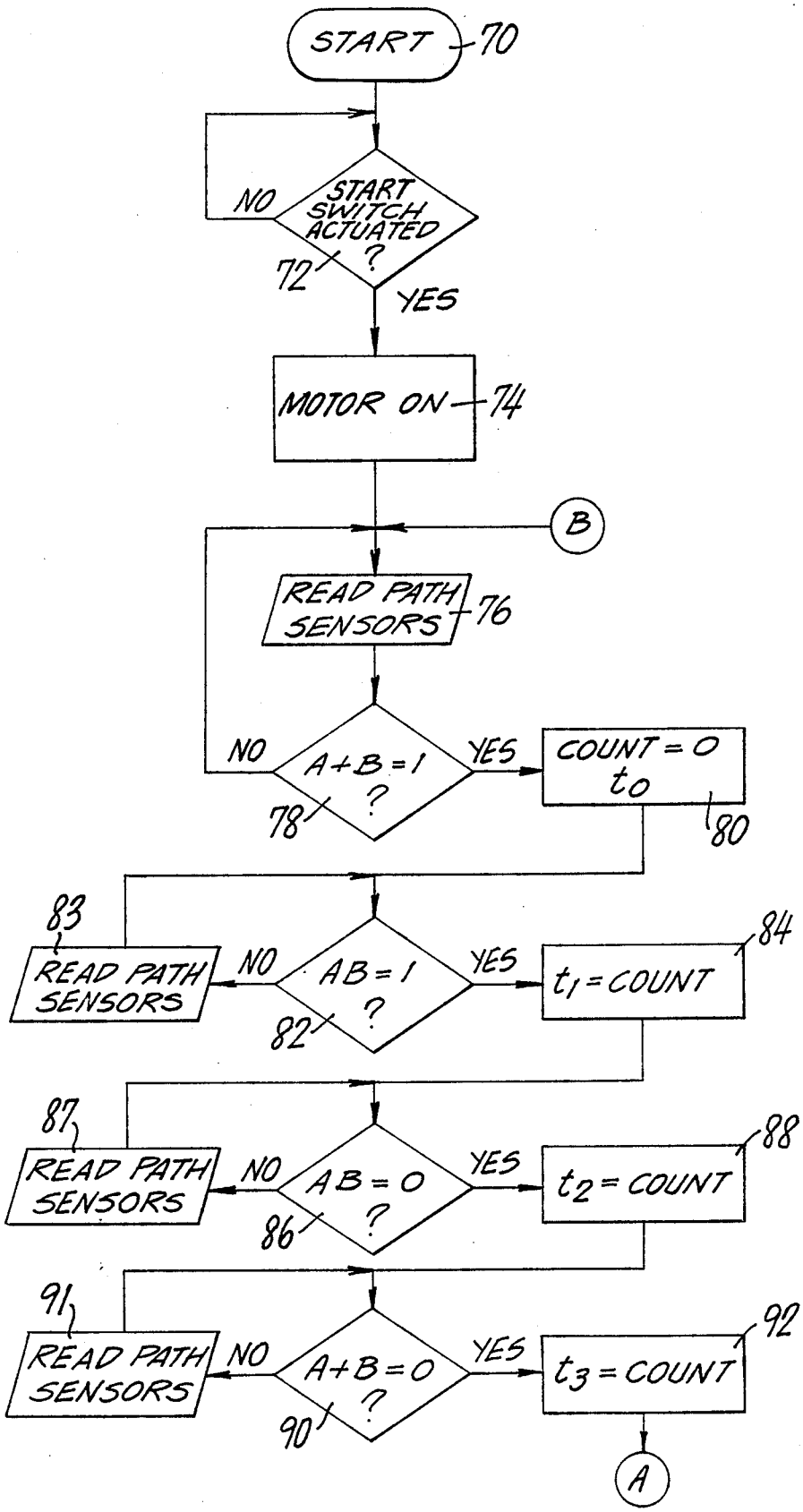
FIGS. 7 and 8 are a flowchart illustrating the manner of operation of the control system shown in FIG. 5.
Figure 8:
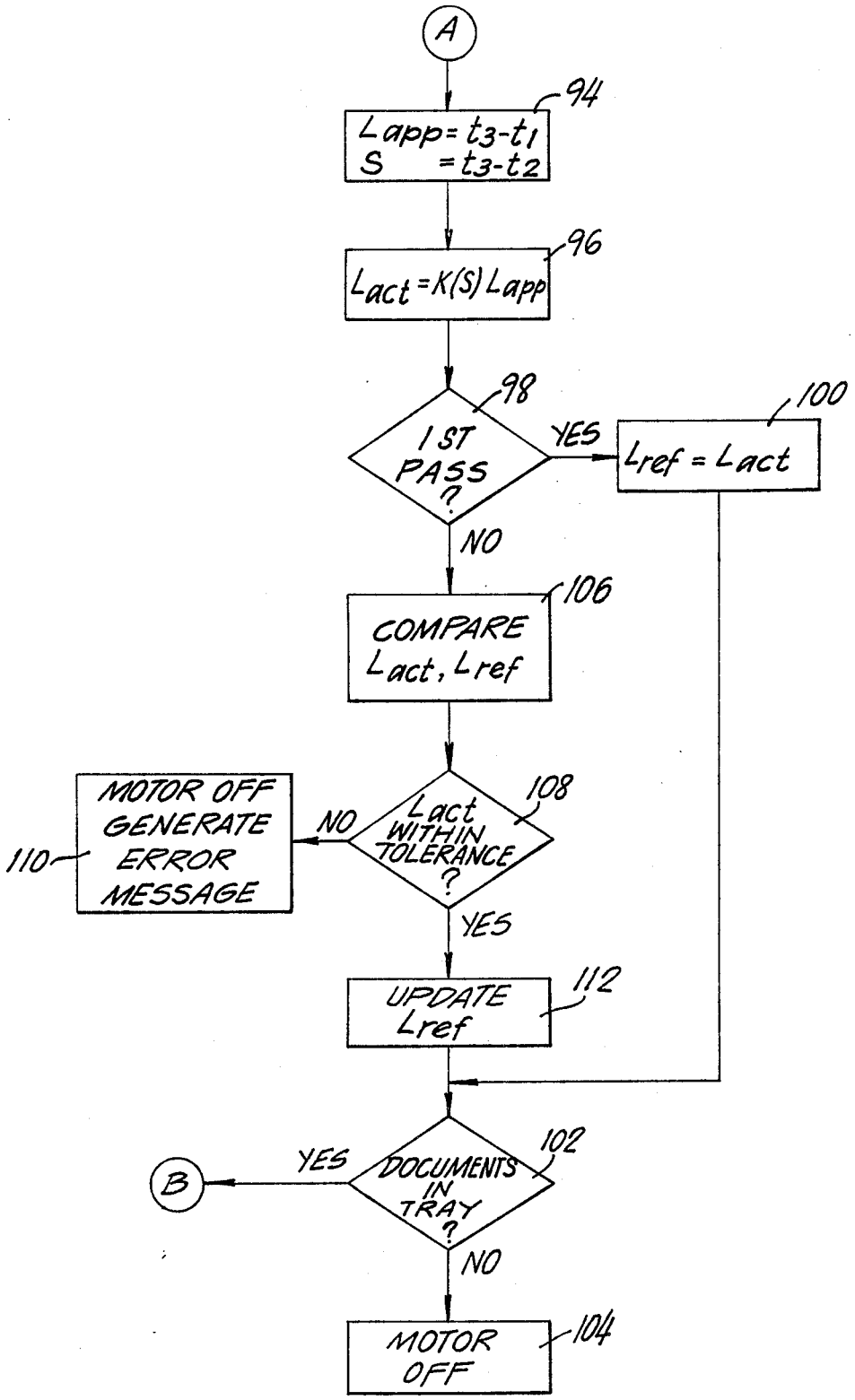

FIGS. 7 and 8 are a flowchart of the sequence of operation of control system 60 as implemented by a suitably programmed microprocessor. It will be understood, however, that the present invention does not depend on any particular hardware configuration, and may be implemented without a microprocessor, using either special-purpose digital logic or analog circuits. After startup (step 70) the routine examines the start switch 62 to determine whether it has been actuated (step 72). When it has, the routine actuates motor 56 (step 74), causing feed rollers 22 to begin to feed sheets 14 successively through nips N1 and N2.

The routine then enters a loop (steps 76–78) in which it repeatedly examines the outputs of path sensors A and B (step 76). If either sensor output is 1 (step 78), the routine initializes an internal counter (not separately shown) responsive to pulses from encoder 38 (step 80), since at this point the sheet 14 is covering at least one of the path sensors. The routine then waits for the logical AND AB of the path sensors to change to 1, indicating that both sensors are covered and that the sheet 14 is within the nip N2 (steps 82–83). This may occur simultaneously with the transition of the logical OR A +B to 1 (step 78) if the sheet 14 is perfectly aligned, but in general will occur afterwards if the sheet has any degree of skew. Upon detecting that the logical AND has changed to 1 (step 82), the routine stores the present count, corresponding to time $t_1$ in FIG. 6, in a $t_1$ register (step 84); the count $t_1$ marks the beginning of a timing interval used to measure the length of sheet 14. The routine then waits for the logical AND AB to change to 0 (steps 86–87). When, at time $t_2$ (FIG. 6), the logical AND AB changes to 0, indicating that one path sensor has just been uncovered (step 86), the routine stores the present count in a $t_2$ register (step 88). The routine then waits for the logical OR A+B to change to 0 (steps 90–91). When, finally, the logical OR A+B changes to 0, indicating that both sensors are now uncovered (step 90), the routine stores the present count in a $t_3$ register (step 92); count $t_3$ marks the end of the timing interval used to measure the length of sheet 14.

The routine then determines the apparent length $L_{app}$ by subtracting $t_1$ from $t_3$, and also determines the skew S by subtracting $t_2$ from $t_3$ (step 94). The routine thereafter derives an actual length measurement $L_{act}$ from the apparent length measurement $L_{app}$ by multiplying the latter by the compensation factor K(S) ($=K(y_3-y_2)$) referred to above (step 96). If the current sheet is the first sheet (step 98), the routine sets the reference length $L_{ref}$ for subsequent comparisons equal to the computed actual length $L_{act}$ (step 100), and then interrogates tray sensor C to determine whether there are any sheets 14 remaining in the tray 16 (step 102). If there are remaining sheets, the routine returns to step 76 in preparation for the next sheet 14 to be fed. Otherwise, the routine shuts off the motor 56 (step 104).

On subsequent passes at step 98, the routine compares the actual length $L_{act}$ calculated for the current sheet 14 with the previously set reference length $L_{ref}$ (step 106). The comparison may be performed in a number of ways, such as by determining whether the difference between $L_{act}$ and $L_{ref}$ falls within a predetermined range or whether the ratio of $L_{act}$ and $L_{ref}$ falls within a predetermined range. If the measured length $L_{act}$ is not within tolerance (step 108), the routine halts motor 56, generates an error message on display 64 and actuates alarm 66 (step 110). If the measured length $L_{act}$ is within tolerance, the routine updates the reference length $L_{ref}$ (step 112) before examining sensor C to determine whether there are any remaining documents in the tray 16. $L_{ref}$ may be updated in any of a number of ways, such as by averaging the current $L_{ref}$ with the current value of $L_{act}$. Alternatively, rather than comparing $L_{act}$ with a reference length $L_{ref}$ that varies in an adaptive manner with the actual measured sheet length, the quantity $L_{ref}$ may be a constant.

Sensors A and B may also be used for purposes other than the detection of sheet length. Thus, the path sensors may be used to count the sheets 14 to facilitate batching operations, and may be used to determine the apparent optical density of the sheets to detect double feeds. Since these functions are well known in the art and are not germane to the present invention, they have not been shown.

Although in the preferred embodiment described herein the sheet length is actually measured, it will be apparent to those skilled in the art that an actual measurement need not be obtained if the only purpose is error detection and an absolute reference is used instead of a composite of previous length measurements. Thus, a fault could be declared if both sensors are deactuated either before the lapse of a predetermined minimum time interval following the actuation of both sensors or after the lapse of a predetermined maximum time interval following the actuation of both sensors.

It will be seen that I have accomplished the objects of my invention. My sheet length detector compensates for skew, and operates even in the presence of initial slippage. It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a sheet feeder having first means for advancing a sheet along a path having a centerline to a nip formed by second feed means in which said sheet is subject to slippage relative to said first feed means before reaching said nip, apparatus for detecting sheet length including in combination a pair of sheet sensors disposed at transversely spaced locations along said path on either side of said centerline, each of said sensors being actuatable between two distinct conditions, means for producing a first signal in response to the actuation of both of said sheet sensors to the same one of said conditions by the leading edge of a bill, means for producing a second signal in response to the actuation of both of said sheet sensors to the other one of said conditions by the trailing edge of the bill and means responsive to said first and second signals for providing a measure of sheet length.

2. Apparatus as in claim 1 in which said signal responsive means generates a predetermined signal in response to the deactuation of both of said sensors before the lapse of a predetermined time interval.

3. Apparatus as in claim 1 in which said signal responsive means generates a predetermined signal in response to the lapse of a predetermined time interval before the deactuation of both of said sensors.

4. In a sheet feeder having first means for advancing a sheet along a path having a centerline to a nip formed by second feed means in which said sheet is subjected to slippage relative to said first feed means before reaching said nip, apparatus for measuring the length of a sheet moving along said path including in combination a pair of sheet sensors disposed at transversely spaced locations along said path on either side of said centerline, each of said sensors being actuatable between two distinct conditions, signal responsive means adapted to be operated to generate time measurements, means responsive to actuation of one of said sensors to one of said conditions by the leading edge of said bill for producing a first signal, said first signal setting said signal responsive means in operation, means responsive to the actuation of both of said sensors to said one condition by said leading edge of said bill for producing a second signal, said second signal operating said signal responsive means to generate a first time measurement, means responsive to the actuation of one of said sensors to the other of said conditions by the passage of the trailing edge of said bill for producing a third signal, said third signal operating said signal responsive means to generate a second time measurement, means responsive to the actuation of both of said sheet sensors to the other one of said conditions by the passage of the trailing edge of said bill for producing a fourth signal, said fourth signal operating said signal responsive means to generate a third time measurement and means responsive to said time measurements for providing a measure of the length of said sheet.

5. Apparatus as in claim 4 in which said timing means comprises a pulse generator and a counter responsive to said pulse generator.

6. Apparatus as in claim 5 in which said second feed means includes a movable feed member, said pulse generator generating pulses synchronously with the movement of said member.

7. Apparatus as in claim 4 in which said means responsive to said time measurements comprises means responsive to said first and third time measurements for producing an apparent length measurement, means responsive to said second and third time measurements for providing a measure of skew and means responsive to said skew measure for correcting said apparent length measurement.

8. A method of measuring sheet length in a sheet feeder having a pair of sheet sensors actuatable between two distinct conditions and disposed at transversely spaced locations on either side of the centerline of a path along which a sheet is advanced including the steps of producing a first signal in response to the actuation of both of said sheet sensors to the same one of said conditions by the leading edge of a bill, producing a second signal in response to the actuation of both of said sheet sensors to the other one of said conditions by the trailing edge of the bill, measuring the time interval between the occurrence of said first and second signals and converting said time interval measurement into a measure of sheet length.

9. A method as in claim 8 in which said measuring step comprises the steps of generating a train of pulses and counting the number of said pulses between the occurrence of said first signal and the occurrence of said second signal.

10. A method as in claim 9 in which said pulse generating step comprises generating said pulses in synchronism with the movement of said sheet.

11. A method as in claim 8 in which a predetermined signal is generated in response to the lapse of a predetermined time interval before the deactuation of both of said sensors.

12. A method as in claim 8 in which a predetermined signal is generated in response to the deactuation of both of said sensors before the lapse of a predetermined time interval.

13. A method of measuring sheet length in a sheet feeder having a pair of sheet sensors actuatable between two distinct conditions and disposed at transversely spaced locations on either side of a path along which a sheet is advanced including the steps of measuring a first time interval between the actuation of one of said sensors to one of said conditions by the leading edge of a bill and the actuation of both of said sensors to said one condition by the leading edge of a bill, measuring a second time interval between the end of said first interval and the actuation of one of said sensors to the other condition by the trailing edge of a bill, measuring a third time interval between the end of said first interval and the actuation of both of said sensors to the other condition by the trailing edge of the bill, and calculating the length of said sheet from said measurements.

14. A method as in claim 13 in which said calculating step comprises calculating the apparent length of said sheet from said first and third measurements, calculating sheet skew from said second and third measurements and correcting said apparent length calculation by said skew calculation.

* * * * *